US005927123A

United States Patent [19]

Liu

[11] Patent Number: 5,927,123

[45] Date of Patent: Jul. 27, 1999

[54] COIL SPRING SHAPER

[76] Inventor: Ching-Liang Liu, No. 63, Ta-Jen Rd., Hen-Shan Village, Yen-Tsao Hsiang, Kaohsiung Hsien, Taiwan

[21] Appl. No.: 09/136,065

[22] Filed: Aug. 19, 1998

[51] Int. Cl.[6] ..... B21F 11/00; B21F 35/02

[52] U.S. Cl. ..... 72/129; 72/137

[58] Field of Search ..... 72/129, 132, 135, 72/136, 137, 139, 142, 148, 167, 166

[56] References Cited

U.S. PATENT DOCUMENTS 1,394,095 10/1921 Knoth ..... 72/142

4,967,580 11/1990 Morita ..... 72/139

*Primary Examiner*—Joseph J. Hail, III

*Assistant Examiner*—Rodney Butler

*Attorney, Agent, or Firm*—Dougherty & Troxell

[57] ABSTRACT

A coil spring shaper includes a table, a winding shaft unit, a material feeding unit, a cutter, and a material hanger. The winding shaft unit is fixed on an upper surface of the table, receiving linear material from the material feeding unit movable a rail on the upper surface of the table, and winding the material pinched by an automatic pincher on its winding shaft rotated by a motor into a half-finished coil spring, and cut material with a cutter located opposite to the winding shaft. The material hanger is located near the material feeding unit, dispensing the material to the material feeding unit.

11 Claims, 5 Drawing Sheets

COIL SPRING SHAPER

BACKGROUND OF THE INVENTION

This invention relates to a coil spring shaper, particularly to one having a structure for easy operation, low cost, low energy consumption, capable to make springs of accurate size and with no excessive part, not to harm or scar material, to leave low stress, and possible to produce completely automatically.

FIG. 1*a* shows a spring made with a conventional flat-head coil spring shaper, and it has two hook-shaped excessive end portions a'. But the two hook-shaped excessive portions a' are to be cut off to make the spring completely finished, as common coil springs should have two ends being cut neatly, without any excessive end portions. As the excessive end portions of a finished spring not only additionally increases cost of the spring and of equipment, but wastes material, i.e. naked steel wire used for coil springs, not meeting economical gain.

Further, the conventional flat-head coil spring shaper has many rollers and other components, and coil springs made with it have a large common difference not only of length but of the inner and outer diameters.

Further, it may have other disadvantages of producing harmed and scarred finished coil springs and high stress left therein by friction caused in many processes required by the excessively complicated structure of the conventional flat-head coil spring shaper.

In addition, the conventional flat-head coil spring shaper has considerably many motors to produce large noise in producing processes. And they are generally AC ones, having to rotate idly when they are in waiting condition, wasting electricity in a large degree (servomotors may not need to rotate idly). Further, it has a large heavy table, having as much as 15 tons for shaping a coil spring of 16 mm diameter. Then it costs a great deal and results in a large disadvantage for installing or transporting.

SUMMARY OF THE INVENTION

This invention has been devised to offer a kind of coil spring shaper capable to produce coil springs of accurate size with no excessive end portions, not harming or scaring material, leaving low stress, easy to handle, of low producing cost, needing only low energy consumption, and producing completely automatically.

The coil spring shaper in the invention includes a table for positioning other components, rails provided on a lengthwise side of the table for some components to move thereon, a material feeding unit lying on the rail to move back and forth to continually feed material, a winding shaft unit mounted on an upper surface for pinching and winding material fed by the material feeding unit into half-finished coil springs and having a winding shaft rotated by a motor and an automatic pincher mounted on the winding shaft and rotated together with the winding shaft for pinching the material, and a cutter mounted on a rear portion of the upper surface of the table to located opposite the winding shaft for cutting half-finished coil springs sent by the material feeding unit from the material.

BRIEF DESCRIPTION OF DRAWINGS

This invention will be better understood by referring to the accompanying drawings, wherein.

DETAILED DESCRIPTION OF THE PREFERRED EMBODIMENT

Figure 2:
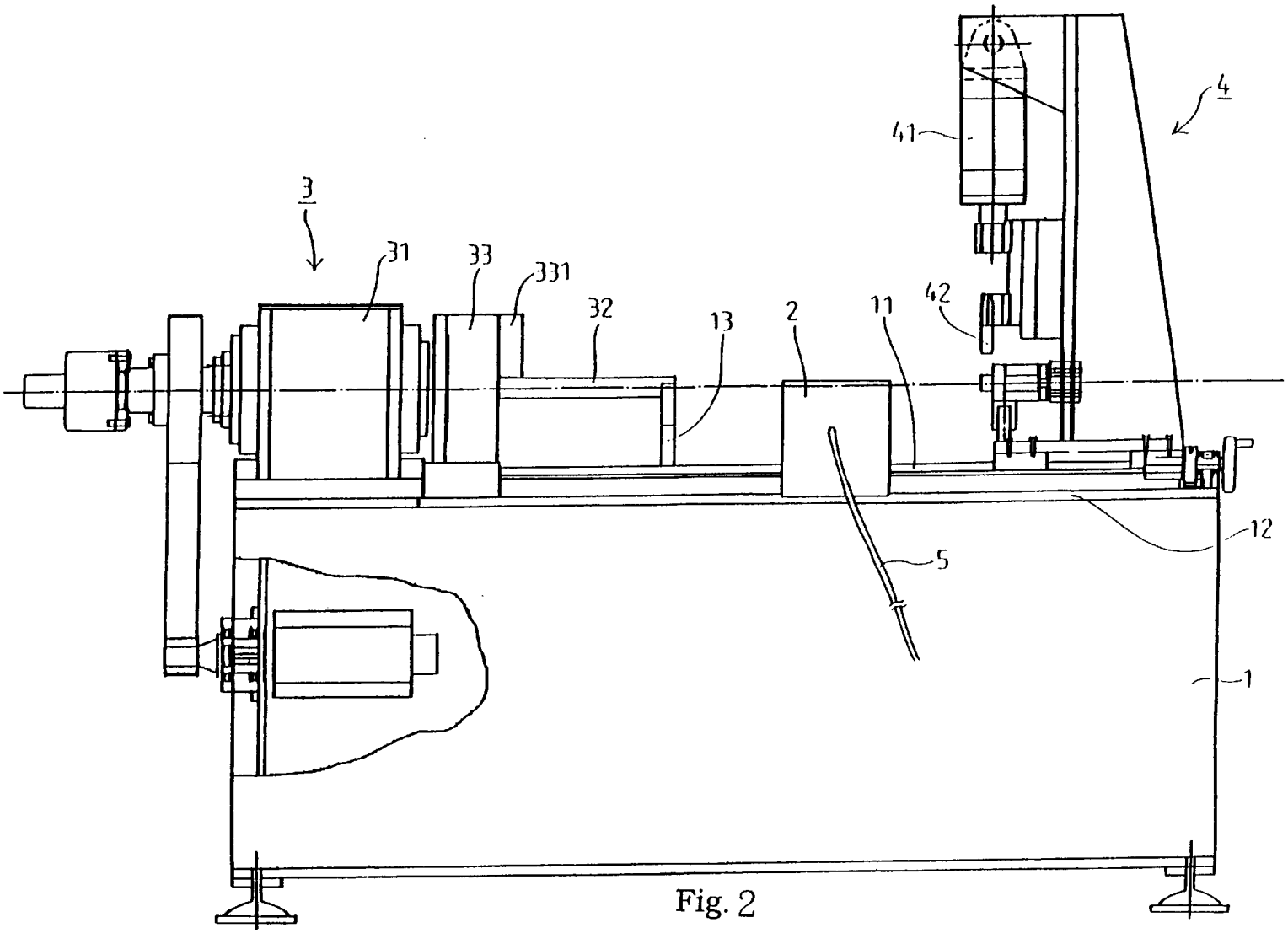
FIG. 2 is a front view of a coil spring shaper in the present invention.
Figures 3, 4:
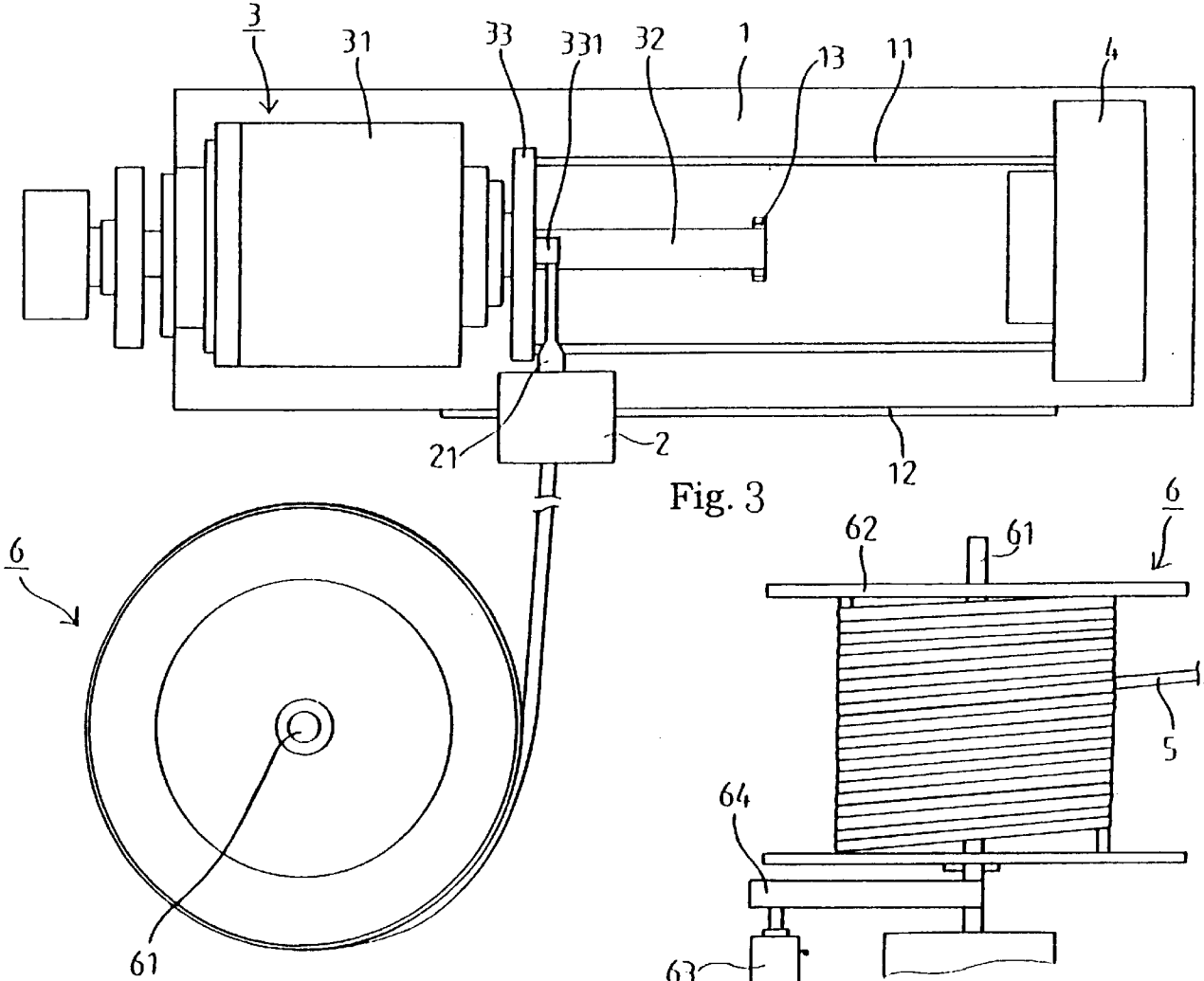
FIG. 3 is an upper view of a coil spring shaper in the present invention.
FIG. 4 is an upper vies of a material hanger in the present invention.

A preferred embodiment of a coil spring shaper in the present invention, as shown in FIGS. 2, 3 and 4, includes a table 1 for positioning other components, a material feeding unit 2 for moving and continually feeding material steel wire 5, a winding unit 3 for pinching and winding material 5, a cutter 4 facing the winding unit 3 for cutting half-finished coil springs, and a material hanger 6 for hanging material and supplying it to the material feeding unit 2.

The table 1 has a rail 11 at one side for the cutter 4 to lie and move back and forth thereon, and another rail 12 at the other side for the material feeding unit 2 to lie and five back and forth thereon.

The material feeding unit 2 has a feeding head 21 fixed at a front end for molding linear material 5 in stabilized condition and feeding it to the winding shaft unit 3. Then the material feeding unit 2 feeds linear material 5, and the feeding head 21 may reserve a proper length of linear material 5, 10–15 cm for convenience of winding and shaping, with the material feeding unit 2 incessantly feeding linear material 5 in shaping process of coil springs.

The winding shaft unit 3 is located on an upper surface of the table 1, consisting of a motor 31, a winding shaft 32 rotated by the motor 31, and an automatic pincher 33 mounted on and rotating together with the winding shaft 32 and having a pinching head 331 fixed sidewise forward. The length and diameter of the winding shaft 32 can be changed, depending on the size of coil springs wanted.

Figure 5:
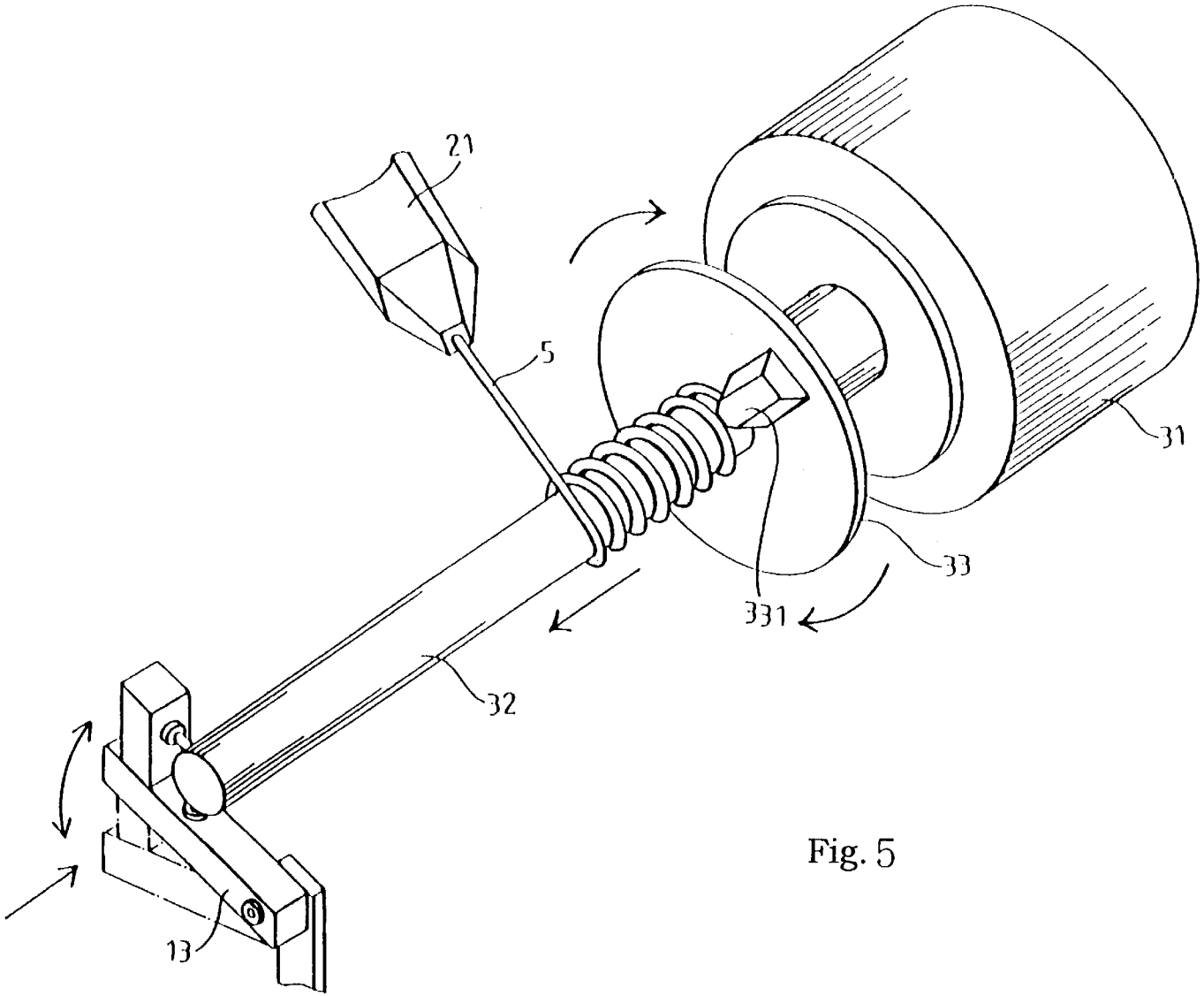
FIG. 5 is a perspective view of a coil spring being made in the coil spring shaper in the present invention; and, FIG. 6 is flowing views of a process of making a coil spring with the coil spring shaper in the present invention.
Figure 6A:
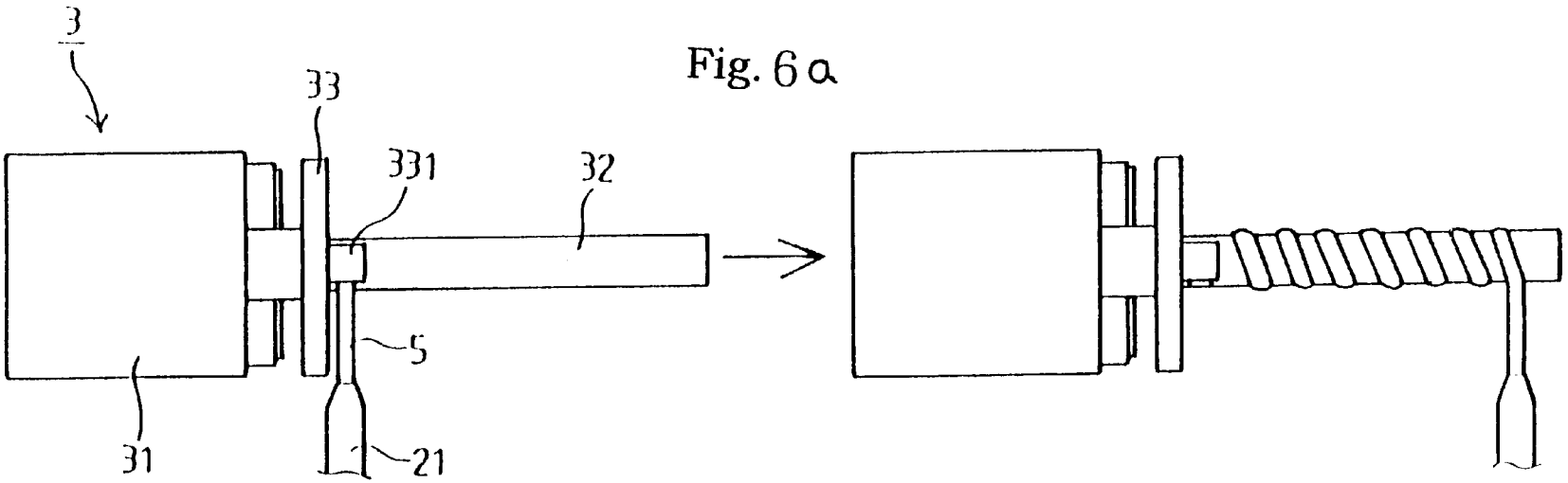
Figure 6B:
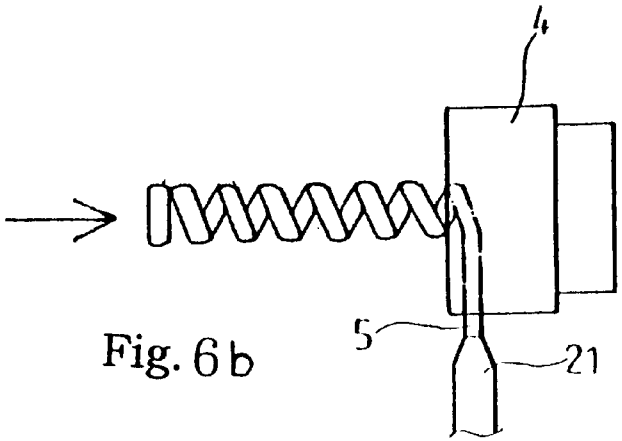

Operation of the coil spring machine is to be described as follows. Referring to FIGS. 2 and 5, when the material feeding unit 2 moves linear material 5 to the upper surface of the winding shaft 32 of the winding shaft unit 3, the pinching head 331 of the automatic pincher 33 catches hold of 5–7 mm of the material 5 on the winding shaft 32, and then the winding shaft 32 is rotated by the motor 31, gradually forming the material 5 into a coil spring around the winding shaft 32, with the material feeding unit 2 moving farther and farther on the rail 12 continually and steadily from the automatic pincher 33, with linear material 5 gradually wound into a half-finished coil spring. Winding direction of the winding shaft 32 is the same as that of pinching the linear material 5 so that the end of the coil spring may not produce a hook-shaped excessive end portion. When a coil spring is formed to a preset length on the winding shaft 32, the winding shaft 32 will stop, ready for a next operation. The motor 31 should use a servomotor so that it may stop temporarily after a coil spring is formed, and starts again to make a next coil spring, without necessity to make the motor 31 rotate idly in the interruption.

Next, as shown in FIG. 4, in order to avoid drooping down of the winding shaft 32 due to its excessive length or disfigurement of coil springs shaped, a shaft supporter 13 is provided near the end of the winding shaft 32 on the upper surface of the table 1. And as shown in FIG. 5, the shaft supporter 13 can be lifted up and down by oil pressure, moved up to support the winding shaft 32 during processing of shaping a coil spring and moved down to let a half-finished coil spring on the winding shaft 32 taken off.

The cutter 4 is movably placed on an end of the rail 11 oppositely to the winding shaft 32 for cutting a half-finished coil spring shaped from the linear material A. The material feeding unit 2 carries the half-finished coil spring to the cutter 4, moving on the rail 12. But the cutter 4 may also be movable on the rail 11 in adjusting its location according to the length of the winding shaft 32 for convenience of operation. Further, as shown in FIG. 2, the cutter 4 has an oil pressure moving device 41, and a knife 42 moved up and down by the oil pressure moving device 41 for cutting a coil spring half-finished, able to be taken off for sharping repeatedly if it is worn off, having an economic design to save equipment cost.

Further, in order to supply linear material 5 in due time and in the stabilized condition, a material hanger 6 is additionally provided beside the table 1 near the material feeding unit 2. The material hanger 6, as shown in FIG. 4, consists of a shaft 61, a material winding cylinder 62 with the shaft 61 fixed firmly through an axis of the material cylinder 62, a motor 63 rotating an endless belt 64 to rotate the shaft 61 for dispensing linear material 5 wound on the cylinder 62 to the material feeding unit 2. And the motor 63 is preferably a servomotor.

Linear material 5 is wound on the cylinder 62 of the material hanger 6 and extends to pass through the feeding head 21 of the material feeding unit 2 and then to be wound around the winding shaft 32 to shape a coil spring. When the winding shaft 32 begins to wind the material around thereon, a control computer sends a signal to the motor 63, which then rotates to indirectly rotate the material cylinder 62, with the material 5 dispensed out to the feeding unit 2 and to the feeding head 21 and then to the winding shaft 32. After the winding shaft 32 winds linear material 5 to a preset length, the control computer commands to stop the winding shaft 32 and the motor 63. Then the winding shaft 32 waits in a stopped condition until the material feeding unit 2 carries the half-finished coil spring just shaped to the cutter 4 and cut off. Then the winding shaft 32 begins to wind a next coil spring at command of the control computer for starting the motor 63 as described above, repeating the same process for shaping another coil spring.

When the material 5 stored on the material cylinder 62 is used up, the material cylinder 62 is taken off the shaft 61, and a new material cylinder 62 with linear material 5 wound thereon can be mounted on the shaft 61, with the linear material A pulled to be inserted through the feeding head 21 very quickly so as to continue shaping work of coil springs.

Figure 1A:
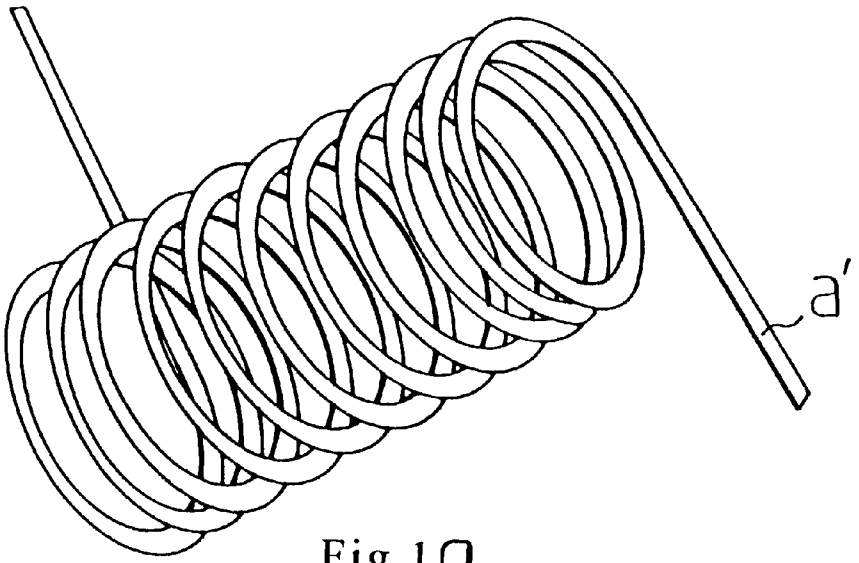
Fig. 1a PRIOR ART
FIG. 1*a* is a perspective view of a coil spring respectively made with a conventional flat-head coil spring shaper.
Figure 1B:
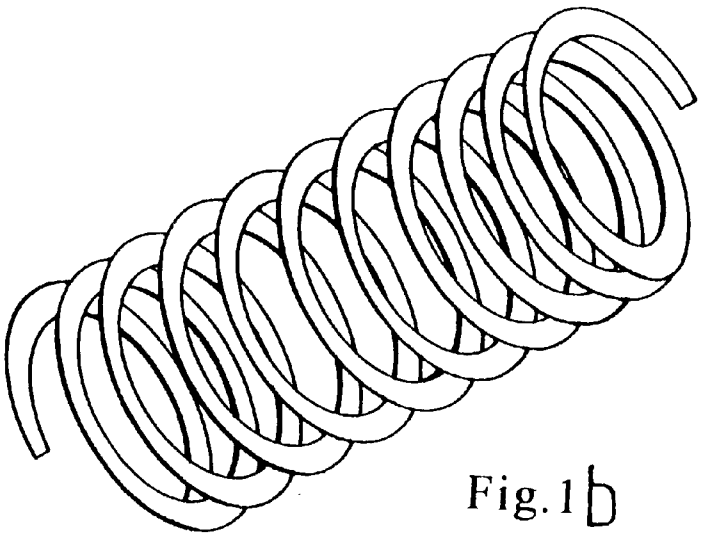
FIG. 1*b* is a perspective view of a coil spring made with a coil spring shaper of the present invention.

In general, flowing shaping process of coil springs with the coil spring shaper in the present invention is to first feed 10–15 cm of material A from the material feeding unit 2 to the winding shift 32, secondly to pinch 5–7 mm of material A on the winding shaft 32 by the pinching head 21, thirdly to start the motor 31 to rotate the winding shaft 32 for winding material A into a half-finished coil spring, and finally to carry the half-finished coil spring with the material feeding unit 2 to the cutter 4 for cutting the half-finished coil spring off the material A. Therefore, the shaping process by this coil spring shaper is quite simple, and finished coil springs a are shaped as shown in FIG. 1, with no excessive end portion, resulting in very few waste of material A and no additional work to remove the excessive end portion. Further, its structure can save friction against material A, lowering harm to finished coil springs and embarrassing noise.

In the shaping process of coil springs with the coil spring shaper in the invention, only the winding shaft may be altered manually in its diameter and length and position of the cutter may be altered manually. But other parameters, such as feeding speed of the material A, the time of pinching material A by the automatic pincher 33, the process of winding material into a coil spring, cutting of half-finished coil springs, the speed of shaping coil springs, the number of rounds of a coil spring, the length of half-finished coil springs shaped on the winding shaft, etc., can be controlled through the control computer. Then production of coil springs with the coil spring shaper of the invention may be performed automatically to obtain finished products of accurate size, with common difference of the length of finished coil springs being only 0.5 mm compared with the common difference 4 mm of those made with the conventional coil spring shaper. The time needed to change the winding shaft may be within 5 minutes, while conventional flat-head coil spring shaper may need an hour to do the same changing work, not effective nor profitable. In addition, weight of the shaper in the invention is as low as 2 tons, compared with 15 tons of the conventional flat-head coil spring shaper, with the cost lowered a great deal.

The coil spring shaper in the invention has the following advantages.

1. Process cost and material cost both can be saved a lot, as there is no excessive end portion to be cut off half-finished coil springs made by it.

2. Coil springs finished all have accurate size, with common difference of length being very smaller than those made by the conventional flat-head coil spring shaper capable to meet strict size demand.

3. Material does not have to move around several rollers as does that in the conventional flat-head coil spring shaper, so finished coil springs made by it have no harms or scars.

4. Its mechanical structure is so simple that producing process is smooth and swift, increasing productivity and enticing quality control and market competitiveness.

5. The table weight is lowered a great deal due to simple structural design, saving its cost largely.

6. Electricity can be saved a great extent, because servomotors are used in addition to the simple structure, and consequently friction among components is also decreased, resulting in noise lowered.

While the preferred embodiment of the invention has been described above, it will be recognized and understood that various modifications may be made therein and the appended claims are intended to cover all such modifications which may fall within the spirit and scope of the invention.

What is claimed is:

1. A coil spring shaper comprising:

a table having at least one lengthwise rail mounted thereon;

a material feeding unit mounted on a first of said at least one lengthwise rail of said table so as to move back and forth, for feeding a linear material;

a winding shaft unit mounted on an upper surface of said table, the winding shaft unit having a rotatable winding shaft for pinching and winding said linear material into coil springs, the winding shaft connected to and rotated by a motor and having an automatic material pincher mounted thereon so as to clamp the linear material to said winding shaft and to rotate together with said winding shaft; and, a cutter mounted on the upper surface of said table facing said winding shaft unit, for cutting wound coil springs from the linear material.

2. The coil spring shaper as claimed in claim 1, further comprising a material hanger provided at a side of said table near said material feeding unit for dispensing linear material to said material feeding unit.

3. The coil spring shaper as claimed in claim 1, further comprising a shaft supporter mounted adjacent to an outer end of said winding shaft on the upper surface of said table, for releasably supporting the outer end of said winding shaft so as to prevent said winding shaft from drooping down.

4. The coil spring shaper as claimed in claim 1, wherein said winding shaft is replaceable in said winding shaft unit by a winding shaft of a different length to wind coil springs of different lengths.

5. The coil spring shaper as claimed in claim 1, wherein said winding shaft is replaceable in said winding shaft unit by a winding shaft of different diameter to wind coil springs of different diameters.

6. The coil spring shaper as claimed in claim 1, further comprising a second rail mounted on the upper surface of said table, wherein said cutter is mounted thereon so as to move back and forth.

7. The coil spring shaper as claimed in claim 1, wherein said motor for rotating said winding shaft comprises a servomotor.

8. The coil spring shaper as claimed in claim 1, wherein said cutter comprises an oil pressure moving device having a knife attached thereto and moved by said oil pressure moving device.

9. The coil spring shaper as claimed in claim 1, wherein said material feeding unit comprises a feeding head fixed at a front side for holding and feeding said linear material in a stabilized condition.

10. The coil spring shaper as claimed in claim 2, wherein said material hanger comprises a shaft and a material cylinder, said shaft fitting firmly through said material cylinder, and an endless belt wound around a protruding end of said shaft and rotated by a spindle of a second motor located beside said material cylinder.

11. The coil spring shaper as claimed in claim 10, wherein said second motor of said material hanger rotates to dispense the linear material on said material cylinder to said material feeding unit when said winding shaft begins to wind the linear material into a coil spring; after said linear material is would for a predetermined length, said winding shaft and said second motor of said material hanger together with said material hanger are stopped at the same time; when said winding shaft rotates again to wind a next coil spring, said material hanger is rotated by said second motor to dispense the linear material.

* * * * *